United States Patent [19]

Wyner et al.

[11] Patent Number: 4,808,888

[45] Date of Patent: Feb. 28, 1989

[54] STARTING CIRCUIT FOR GASEOUS DISCHARGE LAMPS

[75] Inventors: Elliot F. Wyner, Peabody, Mass.; Fredrick W. Paget, Mill Valley, Calif.

[73] Assignee: GTE Products Corporation, Danvers, Mass.

[21] Appl. No.: 936,218

[22] Filed: Nov. 28, 1986

[51] Int. Cl.[4] ..... H01J 7/44

[52] U.S. Cl. ..... 315/289; 315/240; 315/290; 315/DIG. 7; 315/241 R; 315/242

[58] Field of Search ..... 315/289, 290, 227 R, 315/224, DIG. 5, DIG. 7, 240, 241 R, 242, 243, 51, 71

[56] References Cited

U.S. PATENT DOCUMENTS

| | | | |
|---|---|---|---|
| 3,383,588 | 5/1968 | Waymouth | 315/242 |
| 3,771,018 | 11/1973 | Wedendorp et al. | 315/51 X |
| 3,917,976 | 11/1975 | Nickolls | 315/258 |
| 3,963,958 | 6/1976 | Nickolls | 315/276 |
| 4,072,878 | 2/1978 | Engel et al. | 315/205 |
| 4,143,304 | 3/1979 | Hitalcau et al. | 315/276 |
| 4,210,850 | 7/1980 | Britton | 315/290 |
| 4,275,337 | 6/1981 | Knoble et al. | 315/289 |
| 4,347,462 | 8/1982 | Apachi et al. | 315/290 |
| 4,381,476 | 4/1983 | Apachi et al. | 315/101 |
| 4,399,390 | 8/1983 | Oshita et al. | 315/101 |
| 4,404,029 | 9/1983 | Iwaya et al. | 252/521 X |
| 4,415,837 | 11/1983 | Sodini | 315/177 |
| 4,445,067 | 4/1984 | Inoue et al. | 315/54 |
| 4,513,227 | 4/1985 | Labadini et al. | 315/290 |
| 4,520,294 | 5/1985 | Iida et al. | 315/50 |
| 4,612,478 | 11/1985 | Payne | 315/DIG. 5 X |
| 4,647,819 | 3/1987 | Wyner et al. | 315/241 R |

FOREIGN PATENT DOCUMENTS

| | | | |
|---|---|---|---|
| 3330266 | 2/1984 | Fed. Rep. of Germany | 315/241 R |
| 136152 | 7/1985 | Japan | 315/51 |
| 136151 | 7/1985 | Japan | 315/51 |
| 136150 | 7/1985 | Japan | 315/51 |
| 2055516 | 7/1979 | United Kingdom | 315/241 R |

*Primary Examiner*—David K. Moore
*Assistant Examiner*—Mark R. Powell
*Attorney, Agent, or Firm*—Carlo S. Bessone

[57] ABSTRACT

A starting and operating circuit for high pressure discharge lamps including a pair of input terminals for connection to an alternating current supply and a pair of output terminals for connection across the lamp. A ballast inductor is connected at its ends in series between one of the input terminals and one of the output terminals and a pulse generator is connected between the output terminals. The pulse generator comprises a non-linear capacitor (NLC) and a semiconductor bipolar thyristor (commonly known as a SIDAC) connected in series, the non-linear capacitor and bipolar thyristor being connected in parallel with the discharge lamp.

13 Claims, 3 Drawing Sheets

STARTING CIRCUIT FOR GASEOUS DISCHARGE LAMPS

FIELD OF THE INVENTION

The present invention relates to gaseous discharge lamps and more particularly to a starting circuit which provides pulse voltages for initiating the discharge in such lamps.

BACKGROUND OF THE INVENTION

Gaseous discharge lamp starting circuits are well known in the art. Generally gaseous discharge lamps usually require a higher voltage for ignition than operation. This occurs since at ignition time, most cold gasses act as insulators, whereas during operation the hot vapors become conductive. As is known, the high voltage requirements for ignition of discharge lamps can be accomplished by appling high open circuit voltages at the line frequency across the discharge lamp or employing starting circuit which provide high voltage pulses to generate initial discharge in the lamp.

A number of high-pressure sodium discharge lamp lighting circuits have been developed in recent years such as that disclosed in U.S. Pat. No. 4,072,878 to Engel et al. The Engel et al patent discloses an apparatus that provides for high-voltage pulses for starting a sodium discharge lamp by using the breakdown characteristics of a Zener diode to provide accurately timed starting pulses. The use of the Zener diode eliminates timing problems encountered when the breakdown characteristics of a glow lamp are used in somewhat similar fashion, as described in U.S. Pat. Nos. 3,917,976 and 3,963,958 to Nuckolls.

Another apparatus for starting and operating a high-pressure sodium lamp is disclosed in U.S. Pat. No. 4,143,304 to Hitchcock et al. The Hitchcock et al apparatus uses a voltage amplification circuit, utilizing two individual capacitors, the output of which is applied across the ballast reactor which is connected to the reactor in an autotransformer relationship. Although the Hitchcock et al circuit works well, it does require a relatively large number of circuit components.

Further, various discharge lamp starting devices have been developed which employ non-linear dielectric elements. For example, U.S. Pat. No. 4,404,029 to Iwaya et al; U.S. Pat. No. 4,381,476 to Adachi et al; U.S. Pat. No. 4,399,390 to Oshita et al; U.S. Pat. No. 4,347,462 to Adachi, and U.S. Pat. No. 4,513,227 to Labadini et al. The references show many variations in the use of starting circuits and devices which utilize the pulse generating capabilities of non-linear elements. Another example of a starting device is shown in a West German patent application disclosure, D.E. No. 33-30-266-A1 of Iwasaki Electric Company in which a temperature sensitive switch, a semiconductor switch and a on-linear capacitor are mounted within the lamp envelope and connected in series across the electrodes of a lamp. The temeprature-sensitive switch is required to isolate the starting circuit from the power supply once the lamp has ignited.

While such prior art devices provide results in the areas intended, there still exists a need to provide a starting circuit for discharge lamps which employs inexpensive small components while providing a wide range of voltage pulses.

Accordingly, an object of the present invention is to provide an improved starting circuit for gaseous discharge lamps.

Another object of the invention is to provide a starting circuit which provides a range of pulse voltages for initiating discharge which is simple and economical in construction and reliable in operation.

Other objects and advantages of the present invention will become apparent from the following description and the appended claims.

BRIEF SUMMARY OF THE INVENTION

In accordance with the present invention, there is provided a starting and operating circuit for gaseous discharge lamps. The circuit comprises a pair of input terminals for connection to an alternating current supply and a pair of output terminals for connection across a lamp. A ballast inductor is connected at its ends in series between one of the input terminals and one of the output terminals and a pulse generating means is connected between the output terminals. The high-voltage pulse generating means comprises a non-linear capacitor (NLC) and a semiconductor bipolar thyristor (commonly known as a SIDAC) connected in series, the non-linear capacitor and bipolar thyristor being connected in parallel with the discharge lamp.

In operation of the circuit of the present invention, the SIDAC device serves the function of delaying the application of line voltage to the NLC device until later in the half cycle of the AC supply and when the SIDAC device switches, a greater current flows into the NLC device then would flow in the absence of the SIDAC device. Accordingly, there is a greater rate of change of current through the ballast inductor when the NLC device reaches saturation voltage which allows a higher voltage pulse to the discharge lamp. In other embodiments of the invention, the circuit includes additional NLC and SIDAC device. Preferably, the breakover voltage $V_{BO}$ of the semiconductor switch is in the range of $V_L < V_{BO} < V_s$, where $V_L$ is the peak lamp operating voltage, and $V_S$ is the peak source voltage.

BEST MODE FOR CARRYING OUT THE INVENTION

For a better understanding of the present invention together with other and further objects, advantages and capabilities thereof, reference is made to the following disclosure and appended claims in conjunction with the above-discussed drawings.

Figure 1:
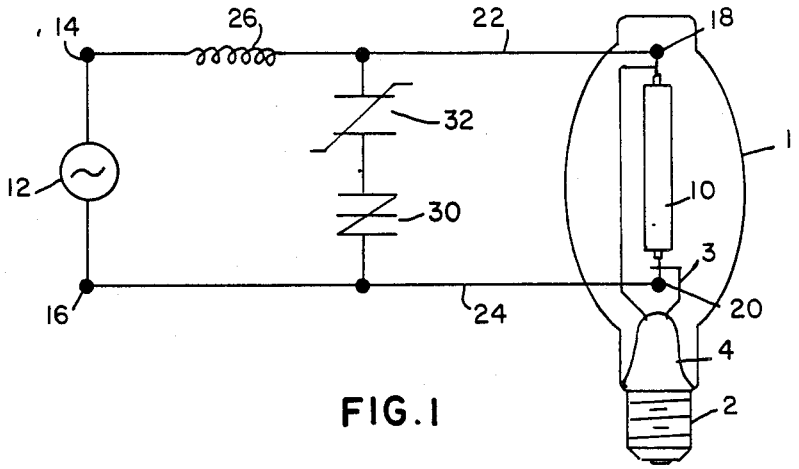
FIG. 1 is a circuit diagram of a discharge lamp starting and operating circuit showing an embodiment of the invention in conjunction with a high intensity discharge lamp having a bulbous envelope and an arc tube.

Referring now to FIG. 1, there is shown an embodiment of the starting circuit of the present invention for a gaseous discharge lamp which may be a high intensity discharge (HID) lamp, such as sodium or other metal halide vapor lamp, which uses a high voltage pulse for a lamp ignition and requires a lower voltage for continued operation of the lamp, once ignited. A conventional glass lamp envelope 1 surrounds the arc tube 10. A conventional lamp base 2 is disposed at the lower end of the envelope 1 to enable the lamp to be screwed into a threaded socket (not shown). The arc tube 10 with a pair of electrodes disposed therein is supported by a conventional frame 3 that is sealed in a stem seal 4 in the bottom of the lamp envelope 1. The starting circuit is powered from a source of AC power 12 fed to input terminals 14 and 16 of the circuit. The arc tube 10 is connected to output terminals 18 and 20 and to the AC power input terminals by line conductors 22 and 24. Line conductors 22 and 24 are shown coming through the bulbous portion of envelope 1 for illustrative purposes only. In practice, the frame 3 connected through stem 4 within the envelope 1 would serve the function of line conductors 22 and 24. Similar considerations apply to FIG. 8. An inductive reactance ballast 26, such as in the form of an iron core and induction coil, is connected in line to conductor 22 in series with arc tube 10 to provide a current limiting impedance as is conventional in discharge lamp circuits. A high voltage pulse generator starter circuit is continuously connected between input terminals 14 and 16 in parallel with lamp 10 and comprises a semiconductor bipolar thyristor switch (SIDAC)30 and a non-linear capacitor (NLC) 32 connected in series. It is to be understood that by the term "continuously connected" is meant an uninterrupted electrical connection between the terminals without having, for example, a mechanical or thermal switch which interrupts the electrical connection. The entire high voltage pulse generator starter circuit can be disposed, for example, within the lamp base. The illustration of it as partially outside is only for ease of illustration. Similar illustrative views are shown in each of the figures of the application.

Figure 2:
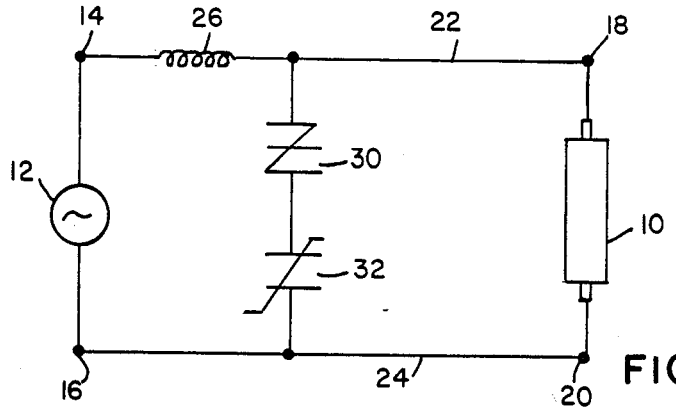
FIGS. 2 to 6 are views of the lamp arc tube with circuits illustrated as circuit diagrams showing modifications of the embodiment of FIG. 1. Although not shown in FIGS. 2 to 6, the arc tube is disposed within a conventional lamp envelope, similar to that which is shown in FIG. 1.

Referring now to FIG. 2, the circuit illustrated differs from the embodiment of FIG. 1 in that the order of series connection of the SIDAC device 30 and the NLC device 32 between line conductors 22 and 24 is reversed. The embodiment of FIG. 3 differs from FIG. 2 in that two SIDAC devices 30*a* and 30*b* are connected in series with the NLC device 32*a* between line conductors 22 and 24. The circuit illustrated in FIG. 4 is similar to that of FIG. 3 except that a second series connection of two SIDAC devices 30*c* and 30*d* and a NLC device 32*b* are connected across line conductors 22 and 24 in parallel with each other.

Figure 5:
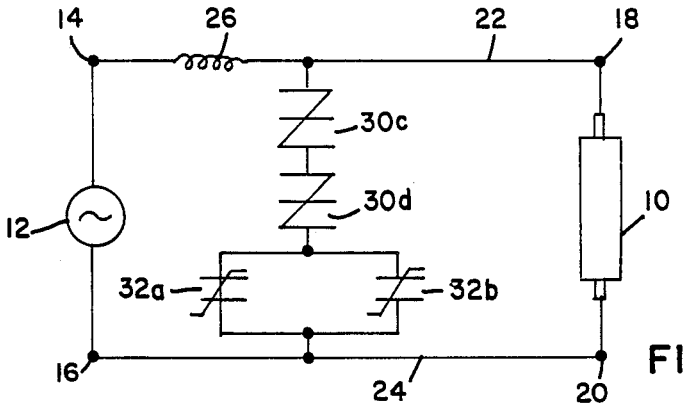
Figure 6:
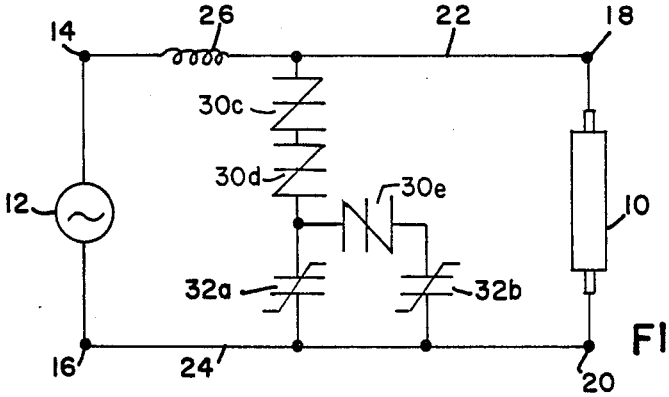
Figure 7:
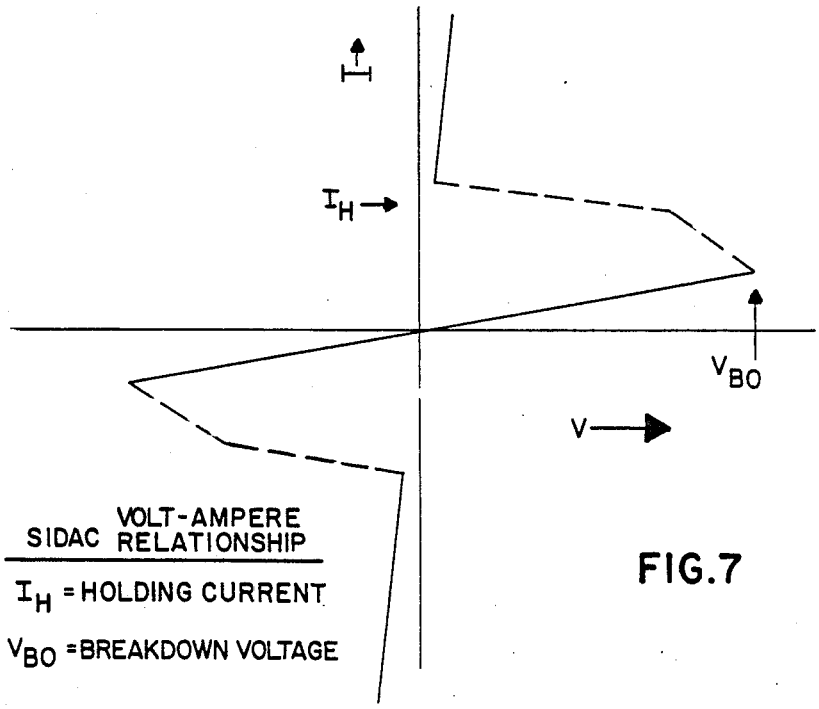
FIG. 7 is a graphical representation of the voltage-ampere relationship of a semiconductor bipolar thyristor.

Referring now to FIG. 5, there is shown a modified embodiment of the invention wherein two SIDAC devices 30*c* and 30*d* are connected in series with a parallel connection of two NLC devices 32*a* and 32*b* across the line conductors 22 and 24. The modified embodiment of the invention illustrated in FIG. 6 is similar to FIG. 5 except that one of the NLC devices in parallel, 32*b*, is connected in series with a SIDAC device 30*e*.

Figure 8:
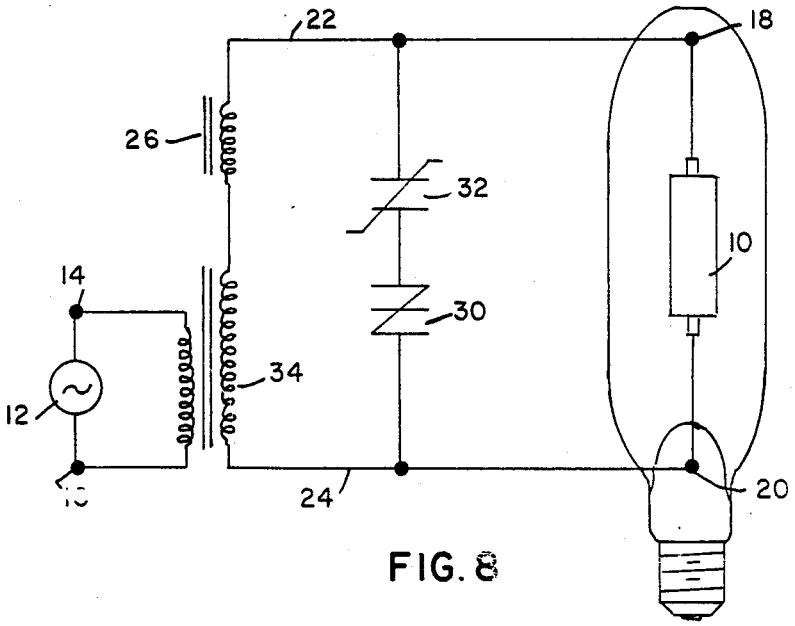
FIG. 8 is a circuit diagram showing a modified embodiment of FIG. 1 wherein the ballast inductor contains a transformer section.
Figure 3:
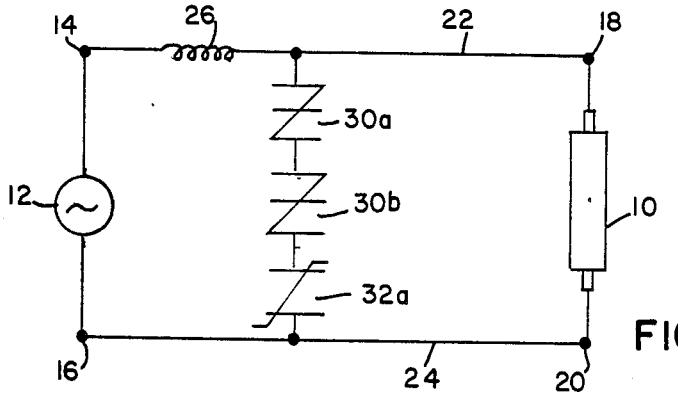
Figure 4:
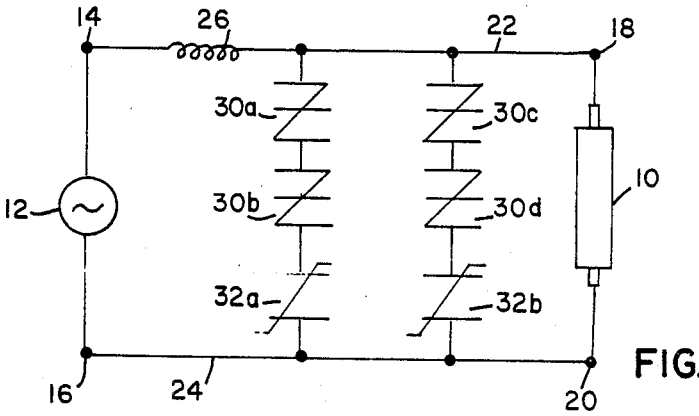

Table 1 illustrates the comparison of the circuits of the present invention as illustrated in FIGS. 1, 3 and 8 of the present invention with the prior art. It should be noted that FIGS. 1 and 3 are equivalents. The circuit of FIG. 8 is the same as FIG. 1, except that the ballast 26 contains a transformer section 34. The NLC device used was a commercially manufactured type NLB1250 having a 12 mm. diameter and a 0.50 mm. thickness. The SIDAC device is a commercially available Shindengen Model K1V12. The ballasts were a standard 120 volt ballast and a standard 100 watt mercury ballast (mercury) having a transformer section. The lamp is typical.

TABLE 1

| Circuit | Ballast | SIDAC | NLC | Peak Voltage | Pulse width (microsecs) |
|---|---|---|---|---|---|
| (1) prior art | 120 v | None | One | 630 | 85 |
| (2) FIG. 1 | 120 v | One | One | 1380 | 51 |
| (3) FIG. 3 | 120 v | One | Two | 1820 | 63 |
| (4) prior art | Hg | None | One | 520 | 85 |
| (5) FIG. 8 | Hg | One | One | 1520 | 65 |
| (6) FIG. 8+ | Hg | One | Two | 1800 | 89 |

It should be noted that circuit (1) designated as prior art is the same as circuit 2 (FIG. 1) except that the SIDAC device 30 is omitted. Similarly, circuit 4 designated as prior art is the same as circuit 5 (FIG. 8) except that the SIDAC device 30 is omitted. Also, circuits 5 (FIG. 8) and 6 (FIG. 8+) differ only in that circuit 6 has an additional NLC device (not shown) connected in series with the NLC 30 and SIDAC 32.

Further, it should be noted that when using circuit 1 of Table 1, a typical GTE Sylvania 35 watt high pressure sodium lamp (HPS) could not be started without a starting aid. In contrast, the HPS lamp could be started with circuit 2 (FIG. 1) without the need for the starting aid. In this aspect of the present invention, it can be appreciated that the circuits of the present invention provide additional advantage when employed within the base of arc discharge lamps.

Table 2 illustrates the values of pulse voltage and pulse width, as measured between half intensity points, obtained employing the circuits described in FIGS. 2 to 6 described above. The NLC devices used were of the type NLB1280 formed of a barium titanate dielectric material, as is well known. The SIDAC devices used were of the type K1V as is well known and commercially available and having a breakdown voltage of 90 volts. The ballast inductor is a commercially available type designed to operate the commercially available 100 watt metal halide lamp used. In all circuits, the applied voltage was 240 volts. The circuits of FIGS. 1 and 2 had the same results.

TABLE 2

| Circuit | Pulse Voltage | Pulse width (microsecs) |
|---|---|---|
| (2) FIG. 2 | 1250 | 90 |
| (3) FIG. 3 | 2100 | 80 |
| (4) FIG. 4 | 2200 | 105 |
| (5) FIG. 5 | 2100 | 100 |
| (6) FIG. 6 | 2500 | 90 |

While the invention has been described with respect to preferred embodiments, it will become apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in a limiting sense.

What is claimed is:

1. An electric discharge lamp starting and operating apparatus comprising:

an electric discharge lamp including an arc tube with a pair of electrodes disposed therein, an envelope surrounding said arc tube and having a lamp base disposed at one end thereof, means for supporting said arc tube, and means for connecting said arc tube through said envelope to a power supply;

a pair of input terminals for connection to an alternating current supply;

a pair of output terminals for connection across said lamp;

a ballast inductor connected between one of said input terminals and one of said output terminals;

a connection between the other of said input terminals and the other of said output terminals; and a high voltage starting pulse means providing a high voltage pulse to said lamp electrically connected in shunting relationship to said lamp between said input terminals and said output terminals and disposed entirely within said lamp base, said high voltage pulse means comprising a non-linear dielectric element means and a semiconductor switch means connected in series, said high voltage starting pulse means not including a device for interrupting power to said series connected non-linear dielectric element means and said semiconductor switch means during lamp operation.

2. The starting and operating apparatus of claim 1 wherein said non-linear dielectric element means comprises a non-linear capacitor.

3. The starting and operating apparatus of claim 1 wherein said semiconductor switch means comprises a bi-directional thyristor.

4. The starting and operating apparatus of claim 1 wherein one end of said non-linear dielectric element means is connected between said ballast inductor and said lamp.

5. The starting and operating apparatus of claim 1 wherein said high voltage starting pulse means comprises a pair of semiconductor switch means and a non-linear dielectric element means connected in series.

6. The starting and operating apparatus of claim 1 wherein said high voltage starting pulse means comprises a pair of semiconductor switch means and a pair of parallel connected non-linear dielectric element means connected in series.

7. The starting an operating apparatus of claim 1 wherein said high voltage starting pulse means comprises a pair of semiconductor switch means connected in series with a parallel connections comprising a non-liner dielectric element means and a semiconductor switch means and a non-linear dielectric element means connected in series.

8. The starting and operating apparatus of claim 1 wherein the breakdown voltage of said semiconductor switch means is between the peak lamp operating voltage and the peak supply voltage.

9. The starting and operating apparatus of claim 1 in combination with a high intensity discharge lamp connected across said output terminals of said circuit.

10. An electric discharge lamp starting and operating apparatus comprising:

a pair of input terminals for connection to an alternating current supply;

an electric discharge lamp including an arc tube with a pair of electrodes disposed therein, an envelope surrounding said arc tube and having a lamp base disposed at one end thereof, means for supporting said arc tube, and means for connecting said arc tube through said envelope to a power supply;

a pair of output terminals for connection across said lamp;

a ballast inductor connected between one of said input terminals and one of said output terminals;

a connection between the other of said input terminals and the other of said output terminals; and at least one high voltage starting pulse means providing a high voltage pulse to said lamp electrically connected in shunting relationship to said lamp between said input terminals and said output terminals and disposed entirely within said lamp base, said high voltage pulse means comprising a pair of semiconductor switch means and a non-linear dielectric element means connected in series, said high voltage starting pulse means not including a device for interrupting power to said series connected semiconductor switch means an non-linear dielectric element means during lamp operation.

11. An electric discharge lamp starting and operating apparatus comprising:

an electric discharge lamp including an arc tube with a pair of electrodes disposed therein, an envelope surrounding said arc tube and having a lamp base disposed at one end thereof, means for supporting said arc tube, and means for connecting said arc tube through said envelope to a power supply;

a pair of input terminals for connection to an AC power source;

a pair of output terminals for connection across said lamp;

a ballast inductor means connected in series between said output windings of said transformer means and said lamp; and a high voltage starting pulse means providing a high voltage pulse to said lamp electrically connected in shunting relationship to said lamp between said input terminals and said output terminals and disposed entirely within said lamp base, said high voltage pulse means comprising a non-linear dielectric element means and a semiconductor switch means connected in series, said high voltage starting pulse means not including a device for interrupting power to said series connected non-linear dielectric element means and said semiconductor switch means during lamp operation.

12. A starting and operating apparatus of claim 11 in combination with a high intensity arc discharge tube connected across said output terminals.

13. A starting and operating apparatus of claim 11 wherein the breakover voltage $V_{BO}$ of the semiconductor switch means is in the range of $V_L < V_{BO} < V_S$ where $V_L$ is the peak operating voltage, and $V_S$ is the peak source voltage.

* * * * *